US006382347B1

(12) United States Patent
Gerber

(10) Patent No.: US 6,382,347 B1
(45) Date of Patent: May 7, 2002

(54) EXHAUST MUFFLER FOR AN INTERNAL COMBUSTION ENGINE

(75) Inventor: Brian H. Gerber, Scottsdale, AZ (US)

(73) Assignee: GHL Motorsports, L.L.C., Mesa, AZ (US)

( * ) Notice: Subject to any disclaimer, the term of this patent is extended or adjusted under 35 U.S.C. 154(b) by 0 days.

(21) Appl. No.: 09/851,221

(22) Filed: May 8, 2001

(51) Int. Cl.[7] ..... F01N 7/08

(52) U.S. Cl. ..... 181/227; 181/212; 181/228; 181/238; 181/256; 181/257

(58) Field of Search ..... 181/227, 212, 181/228, 232, 236, 238, 240, 256, 257, 258

(56) References Cited

U.S. PATENT DOCUMENTS

| | | | | |
|---|---|---|---|---|
| 2,725,948 | A | 12/1955 | Keene | 181/43 |
| 4,050,903 | A | 9/1977 | Bailey et al. | 23/288 |
| 4,265,332 | A | 5/1981 | Presnall et al. | 181/211 |
| 4,361,206 | A | 11/1982 | Tsai | 181/255 |
| 4,444,288 | A | 4/1984 | Sekiya et al. | 181/258 |
| 5,162,620 | A | 11/1992 | Ross et al. | 181/220 |
| 5,162,622 | A | 11/1992 | Malmsten | 181/227 |
| 5,248,859 | A | 9/1993 | Boria | 181/238 |
| 5,371,331 | A | 12/1994 | Wall | 181/227 |
| 5,712,455 | A | 1/1998 | Wagner | 181/238 |
| 5,828,013 | A | 10/1998 | Wagner et al. | 181/255 |
| 5,969,299 | A | 10/1999 | Yamaguchi et al. | 181/227 |
| 5,971,097 | A | 10/1999 | Etheve | 181/227 |
| 6,089,348 | A | 7/2000 | Bokor | 181/272 |

*Primary Examiner*—Shih-Yung Hsieh
(74) *Attorney, Agent, or Firm*—Jordan M. Meschkow; Lowell W. Gresham; Meschkow & Gresham, P.L.C.

(57) ABSTRACT

A single-in/single-out exhaust muffler 20 for an internal combustion engine includes a curved inner tube (26), an exhaust inlet (24) in communication with a first leg (32) of the curved inner tube (26), and an exhaust outlet (28) in communication with a second leg (36) of the curved inner tube (26). The exhaust inlet (24) is configured to receive exhaust gas (22) and the exhaust outlet (28) is configured to output the exhaust gas (22). A curved portion (38) interconnects the first and second legs (32 and 36). A sound absorbing material (40) is wrapped around the curved inner tube (26), and a muffler housing (42) encloses the curved inner tube (26) and the sound absorbing material (40). The first leg (32) includes a perforate region (58, 60) and an imperforate region (62, 64) arranged about a circumference (66) of the first leg (32). Likewise, the second leg (36) includes a perforate region (68, 70) and an imperforate region (72, 74) arranged about a circumference (76) of the second leg (36). The second leg (36) is aligned with the first leg (32) so that the imperforate regions (64, 72) face each other on an inside curve (80) of the curved inner tube (26). Alternative embodiments of the muffler (20) include a dual-in/single-out muffler (82), a single-in/dual-out muffler (118), and a dual-in/dual-out muffler (144).

29 Claims, 5 Drawing Sheets

EXHAUST MUFFLER FOR AN INTERNAL COMBUSTION ENGINE

TECHNICAL FIELD OF THE INVENTION

The present invention relates generally to mufflers for modifying the sound produced by the exhaust from internal combustion engines. More specifically, the present invention relates to mufflers that produce a desired resonance accompanied by enhanced engine performance.

BACKGROUND OF THE INVENTION

Various laws have mandated the use of exhaust mufflers with internal combustion engines in order to meet sound attenuation standards on public roadways. High performance engines used in vehicles such as sports cars are generally designed to provide peak power at higher engine speeds. Unfortunately, the conventional exhaust muffler systems used in a vehicle having a high performance engine can produce undesirably high back pressure, thereby limiting top end speed and performance of the vehicle.

Typically, original equipment muffler manufacturers for vehicles, such as sports cars, have been only marginally concerned with this limiting of performance (i.e., horsepower drop) which occurs as a result of the muffler's sound attenuation. Accordingly, owners of high performance automobiles, such as sports cars, have relied on after-market muffler manufacturers to provide higher performance mufflers for their cars, while meeting the legal sound attenuation requirements.

Beyond simply meeting the legal sound attenuation requirements, the owners of high performance sports cars have long sought exhaust mufflers that produce a deep, throaty, "sports car" exhaust sound. That being stated, an exhaust muffler for use in a sports car that produces any high frequency resonance, buzzing, or raspy exhaust sound is highly undesirable because it is irritating to the driver.

Consequently, for many years there have been after-market muffler assemblies available which produce a throaty sports car exhaust sound, while maintaining the sound within legal noise limits and while providing at least somewhat enhanced engine performance. One such after-market muffler has been produced in many similar versions generally known as "glasspack" mufflers. These mufflers employ an elongated tubular casing having a layer of fiberglass material around the inner periphery of the casing. The fiberglass is retained in place in the casing by a perforate tubular shell mounted inside the casing. Various gas-directing partitions or baffle structures is have been used inside the fiberglass retaining shell to assist in dispersing gases and sound for attenuation.

Glasspack mufflers may initially produce the desired throaty sports car sound, but with time, the high gas temperature and exhaust gas velocity break down and erode away the fiberglass. This problem is exacerbated by cars which have catalytic converters because the exhaust gas output from a catalytic converter and reaching the muffler is much hotter than the exhaust gas input into the catalytic converter.

Thermal erosion of fiberglass has been addressed by substituting a ceramic fiber blanket as a sound absorption material in mufflers. While this approach has been suitable to address the thermal breakdown problems caused by the heat of the exhaust gas as it passes through the muffler, the high velocity of the exhaust gas still erodes the ceramic blankets.

The use of partitions in glasspack mufflers to attenuate sound has also been accompanied by undesirable side effects. In particular, the partitions tend to increase back pressure by choking flow through the muffler, thus decreasing engine performance. In addition, the partitions may also increase exhaust gas velocity proximate the fiberglass, thus increasing the rate of fiberglass erosion and breakdown. Furthermore, glasspack mufflers also have a tendency to rap, or make a cracking sound, during acceleration and deceleration caused by sound waves that are not allowed to expand. This sound is highly undesirable to the sports car enthusiast.

Thus, what is needed is an exhaust muffler that is inexpensive, durable under attack of hot and corrosive exhaust gas, and readily adaptable as an after-market replacement for the original equipment mufflers installed in high performance vehicles. Moreover, what is needed is an exhaust muffler that provides efficient noise attenuation while not causing undue back pressure to the engine or undue noise harmonics that are irritating to the driver. That is, an exhaust muffler is needed that provides a throaty sports car sound without degrading engine performance.

SUMMARY OF THE INVENTION

Accordingly, it is an advantage of the present invention that an exhaust muffler for an internal combustion engine is provided.

It is another advantage of the present invention that an exhaust muffler is provided that produces a deep, throaty sound.

It is another advantage of the present invention that a desired resonance is provided without causing undue back pressure to the engine.

It is another advantage of the present invention that the exhaust muffler produces a desired resonance without irritating noise harmonics.

Yet another advantage of the present invention is that an exhaust muffler is provided that is durable, cost effective, and readily adaptable to a number of vehicular exhaust system configurations.

The above and other advantages of the present invention are carried out in one form by an exhaust muffler for an internal combustion engine. The exhaust muffler includes a curved inner tube. The curved inner tube includes a first leg having a first perforate region and a first imperforate region arranged about a circumference of the first leg and a second leg having a second perforate region and a second imperforate region arranged about a circumference of the second leg. The second leg is aligned with the first leg so that the second imperforate region faces the first imperforate region on an inside curve of the curved inner tube. A curved portion of the curved inner tube interconnects the first and second legs. An exhaust inlet is in communication with a first end of the first leg and is configured to receive exhaust gases from the engine. An exhaust outlet is in communication with a second end of the second leg and is configured to output the exhaust gases. A muffler housing encloses the curved inner tube, and the exhaust inlet and the exhaust outlet extend from the muffler housing.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
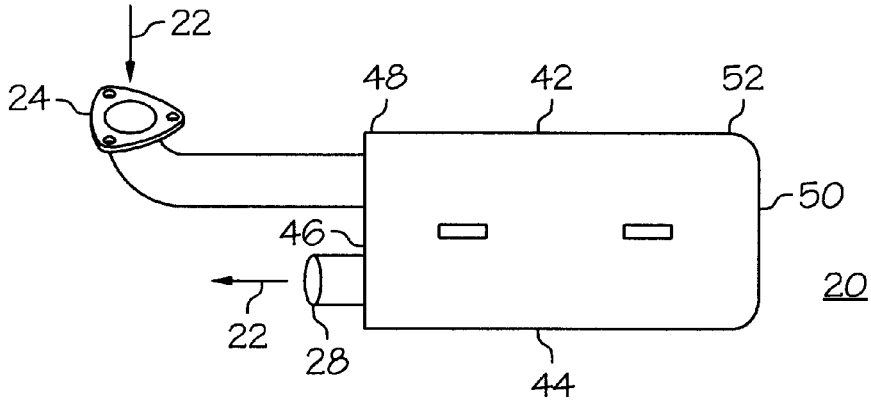
FIG. 1 shows a perspective view of an exhaust muffler in accordance with the present invention.
Figure 2:
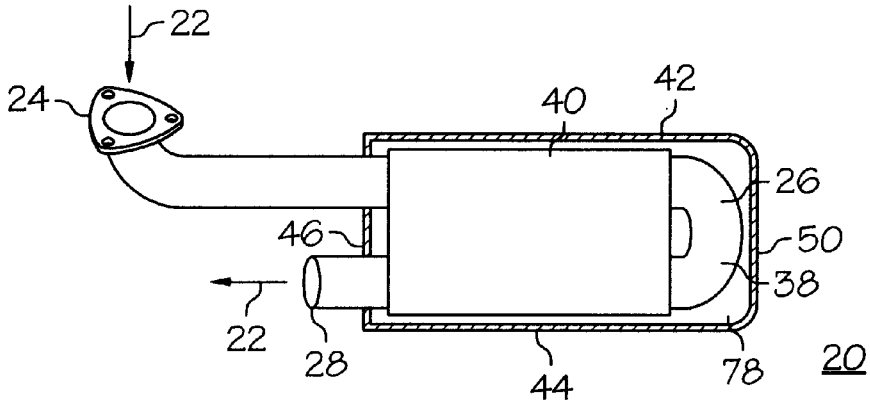
FIG. 2 shows a partial sectional view of the exhaust muffler of FIG. 1.
Figure 3:
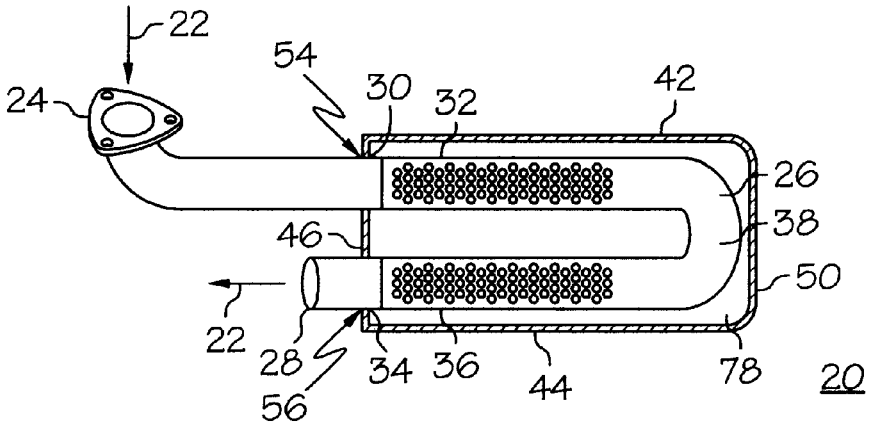
FIG. 3 shows another partial sectional view of the exhaust muffler of FIG. 1.

Referring to FIGS. 1–3, FIG. 1 shows a perspective view of an exhaust muffler 20 in accordance with the present invention. FIG. 2 shows a partial sectional view of exhaust muffler 20, and FIG. 3 shows another partial sectional view of exhaust muffler 20. Exhaust muffler 20 is configured for use with an internal combustion engine. In particular, the internal combustion engine may be a high performance engine normally used in sports cars, such as a Porsche. A sports car enthusiast typically desires a deep, throaty "sports car" exhaust sound to emanate from the car. Moreover, it is desirable that this throaty sports car sound accompanied by enhanced performance of the engine.

Although exhaust muffler 20 is described as being used with an internal combustion engine of a sports car, it should be understood that exhaust muffler 20 may be adapted for use with a variety of vehicles, such as a conventional automobile, truck, van, motorcycle, speed boat, and the like. Moreover, exhaust muffler 20 may be provided as original equipment on a new sports car. Alternatively, exhaust muffler 20 may be provided by an after-market muffler manufacturer.

Exhaust muffler 20 may be coupled to the output of an exhaust manifold, also known as an exhaust header, or a catalytic converter (not shown) whose upstream end is in communication with the exhaust manifold. The exhaust manifold is secured to a number of exhaust tubes, each having an upstream end in communication with separate associated engine exhaust ports of an internal combustion engine (not shown). The latter coupling is described herein.

During engine operation, air is drawn into an intake manifold of the internal combustion engine and directed into the internal combustion engine cylinders. The air drawn into the intake manifold mixes with fuel to enable the combustion process in the cylinders of the internal combustion engine in a conventional manner. The resulting product of this combustion process is exhaust gas, which is discharged from the cylinders.

Exhaust gas is then received by the exhaust tubes and collected at the exhaust manifold. Exhaust gas passes from the exhaust manifold through the catalytic converter and into muffler 20, as represented by arrows 22. Exhaust gas 22 is subsequently exhausted from muffler 20 at the rear of a vehicle (not shown).

Generally, exhaust muffler 20 includes an exhaust inlet 24 configured to receive exhaust gas 22, a curved inner tube 26, and an exhaust outlet 28 configured output exhaust gas 22. Exhaust inlet 24 may couple to the downstream end of a catalytic converter (not shown) of the internal combustion engine (not shown). Exhaust outlet 28 may coupled to an upstream end of a tail pipe (not shown) for subsequent exhaust from the vehicle.

More specifically, exhaust inlet 24 is in communication with a first end 30 of a first leg 32 of curved inner tube 26. Likewise, exhaust outlet 28 is in communication with a second end 34 of a second leg 36 of curved inner tube 26. Curved inner tube 26 further includes a curved portion 38 interconnecting first and second legs 32 and 36, respectively. Exhaust gas 22 received at exhaust inlet 24 flows through first leg 32, curved portion 38, and second leg 36 of curved inner tube 26 to be exhausted at exhaust outlet 28.

As particularly shown in FIG. 2, a sound absorbing material 40 surrounds curved inner tube 26. In a preferred embodiment, sound absorbing material 40 is an industrial grade steel wool mesh wrapped around first and second legs 32 and 36. Steel wool mesh is desirable for cutting the high frequency component of exhaust noise. For example, the steel wool mesh may be wrapped around curved inner tube 26 twice to achieve the desired throaty resonance. In addition, the steel wool mesh is better able to withstand break down due to high gas temperature and exhaust gas velocity than conventional fiberglass packed mufflers.

A muffler housing 42 encloses curved inner tube 26 and sound absorbing material 40. Muffler housing 42 includes a shell 44 surrounding curved inner tube 26. A first end cap 46 is coupled to a first end 48 of shell 44, and a second end cap 50 is coupled to a second end 52 of shell 44. Muffler housing 42 further includes a first port 54 through which exhaust inlet 22 is directed and a second port 56 through which exhaust outlet 26 is directed.

As shown in FIG. 3, sound absorbing material 40 is removed from curved inner tube 26 to reveal curved inner tube 26 as being a generally U-shaped member. Accordingly, both of first and second ports 54 and 56, respectively, are located in first end cap 46.

Exhaust muffler 20 includes a single exhaust inlet, i.e., exhaust inlet 24, and a single exhaust outlet, i.e., exhaust outlet 28. Accordingly, muffler 20 will be referred to hereinafter as single-in/single-out muffler 20 to distinguish it from other exhaust mufflers configured in accordance with alternative embodiments of the present invention (discussed below).

Figure 4:
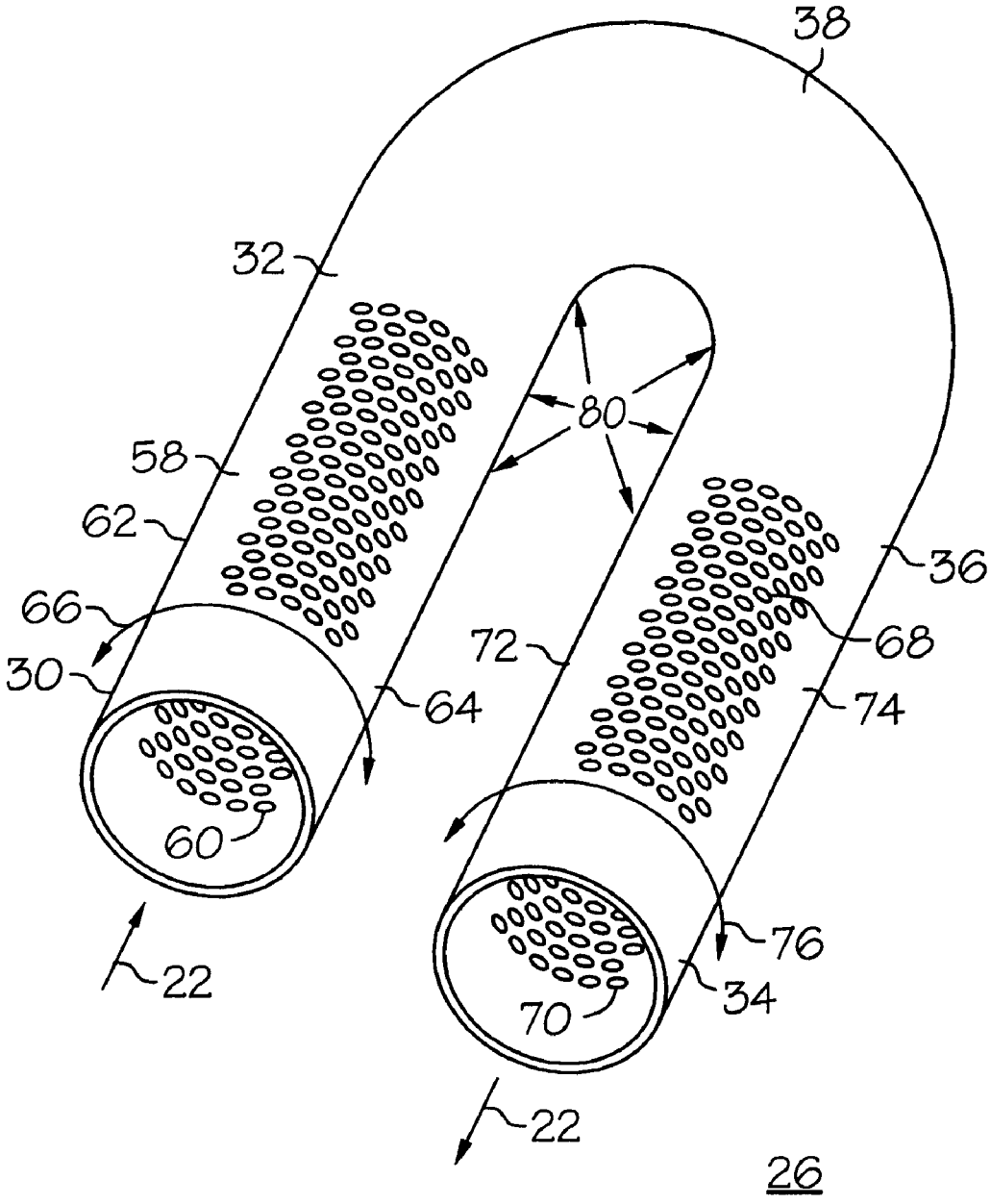
FIG. 4 shows a curved inner tube of the exhaust muffler of FIG. 1.

FIG. 4 shows curved inner tube 26 of single-in/single-out muffler 20 (FIG. 1). As shown, exhaust gas 22 enters first end 30 at first leg 32 and exits second end 34 of second leg 36. First leg 32 of curved inner tube 26 has first and second perforate regions 58 and 60, respectively, and first and second imperforate regions 62 and 64, respectively, located about a circumference (represented by a bi-directional arrow 66) of first leg 32. First perforate region 58 is located about circumference 66 in opposing relationship with second perforate region 60. That is, first perforate region 58 is situated about circumference 66 across the diameter of first leg 32 from second perforate region 60. Likewise, first imperforate region 62 is located about circumference 66 in opposing relationship with second imperforate region 64.

Second leg 36 of curved inner tube 26 has third and fourth perforate regions 68 and 70, respectively, and third and fourth imperforate regions 72 and 74, respectively, located about a circumference (represented by a bi-directional arrow 76) of second leg 36. Third perforate region 68 is located about circumference in opposing relationship with fourth perforate region 70. That is, third perforate region 68 is situated about circumference 76 across the diameter of second leg 36 from fourth perforate region 70. Likewise, third imperforate region 72 is located about circumference 76 in opposing relationship with fourth imperforate region 74.

Curved portion 38 is imperforate to provide strength for curved inner tube 26 and to facilitate the flow of exhaust gas 22 from first leg 32 to second leg 36.

Perforations in first, second, third, and fourth perforate regions 58, 60, 68, and 70, respectively, allow gas expansion of exhaust gas 22 and sound travel through sound absorbing material 40 located in a cavity 78 (FIGS. 2–3) of muffler housing 42. However, second leg 36 is aligned with first leg 32 so that third imperforate region 72 faces second imperforate region 64 on an inside curve 80 of curved inner tube 26. This facing relationship between second and third imperforate regions 64 and 72, respectively, largely inhibits gas expansion and sound travel between first and second legs 32 and 36, respectively.

The inhibition of gas expansion and sound travel between first and second legs 32 and 36 coupled with the inclusion of sound absorbing material 40 results in a desired resonance, that is, a deep, throaty sports car sound. Furthermore, it has been discovered that the deep, throaty sports car sound is accompanied by enhanced engine performance. That is, a largely non-restricted flow of exhaust gas 22 is achieved from first end 30 through second end 34 of curved inner tube 26. This largely non-restricted flow of exhaust gas 22 through curved inner tube 26 results in an increase of engine performance by approximately thirty horsepower over that obtained by an original equipment exhaust muffler.

It has been determined that the paired configurations of perforate regions (i.e., first and second perforate regions 58 and 60 and third and fourth perforate regions 68 and 70) and imperforate regions (i.e., first and second imperforate regions 62 and 64 and third and fourth imperforate regions 72 and 74) produce the desired resonance accompanied by enhanced engine performance in single-in/single-out muffler 20 (FIG. 1). In addition, the inclusion of first imperforate region 62 and fourth imperforate region 74 enhances the strength and durability of muffler 20 (FIG. 1). However, this should not be construed as limiting. For example, single-in/single-out muffler 20 may be configured with perforate regions surrounding the majority of first and second legs 32 and 36, with the only imperforate regions facing each other on inside curve 80.

In a preferred embodiment single-in/single-out muffler 20 (FIG. 1) is manufactured from stainless steel and is TIG welded to achieve durability as well as a pleasing appearance. In addition, muffler 20 may be a direct bolt replacement for the original equipment muffler on sports cars, such as on some model year Porsche sports cars.

Figure 5:
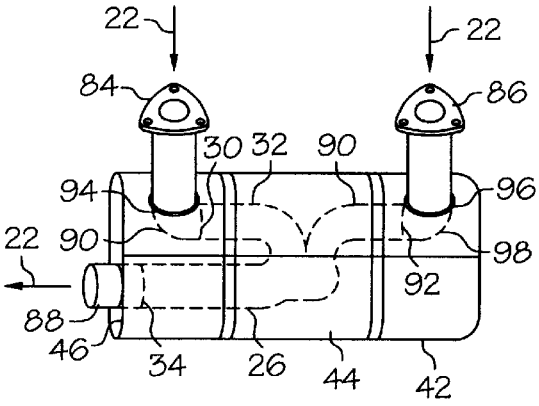
FIG. 5 shows a perspective view of an exhaust muffler in accordance with an alternative embodiment of the present invention.

FIG. 5 shows a perspective view of an exhaust muffler 82 in accordance with an alternative embodiment of the present invention. Exhaust muffler 82 includes a first exhaust inlet 84, a second exhaust inlet 86, and a single exhaust outlet 88. Each of first and second exhaust inlets 84 and 86, respectively, are configured to receive exhaust gas 22 from an internal combustion engine (not shown) and exhaust outlet 88 is configured to output exhaust gas 22. Accordingly, muffler 82 will be referred to hereinafter as dual-in/single-out muffler 82 to distinguish it from other exhaust mufflers configured in accordance with alternative embodiments of the present invention. Dual-in/single-out muffler 82 is a direct bolt replacement for the original equipment dual-in/single-out muffler on sports cars, such as on some model year Porsche sports cars.

Dual-in/single-out muffler 82 is an adaptation of single-in/single-out muffler 20 (FIGS. 1–4). In particular, muffler 82 includes curved inner tube 26 (shown in ghost form). However, dual-in/single-out muffler 82 further includes a second inner tube 90 (shown in ghost form) enclosed by muffler housing 42. First exhaust inlet 84 is in communication with first end 30 of curved inner tube 26 and exhaust outlet 88 is in communication with second end 34 of curved inner tube 26. In addition, second exhaust inlet 86 is in communication with a third end 92 of second inner tube 90. Like single-in/single-out muffler 20, dual-in/single-out muffler 82 also includes sound absorbing material 40 (FIG. 2), in the form of steel wool mesh, wrapped around curved inner tube 26 and second inner tube 90 and enclosed in cavity 78 (FIG. 2) of muffler housing 42.

First and second inlets 84 and 86, respectively, are directed through first and second ports 94 and 96, respectively, located in shell 44 of housing 42. Accordingly, first leg 32 of curved inner tube 26 and second inner tube 90 are adapted, by the inclusion of elbows 98, to accommodate the location of first and second ports 94 and 96. Exhaust outlet 88 is directed through a port in first end cap 46.

Figure 6:
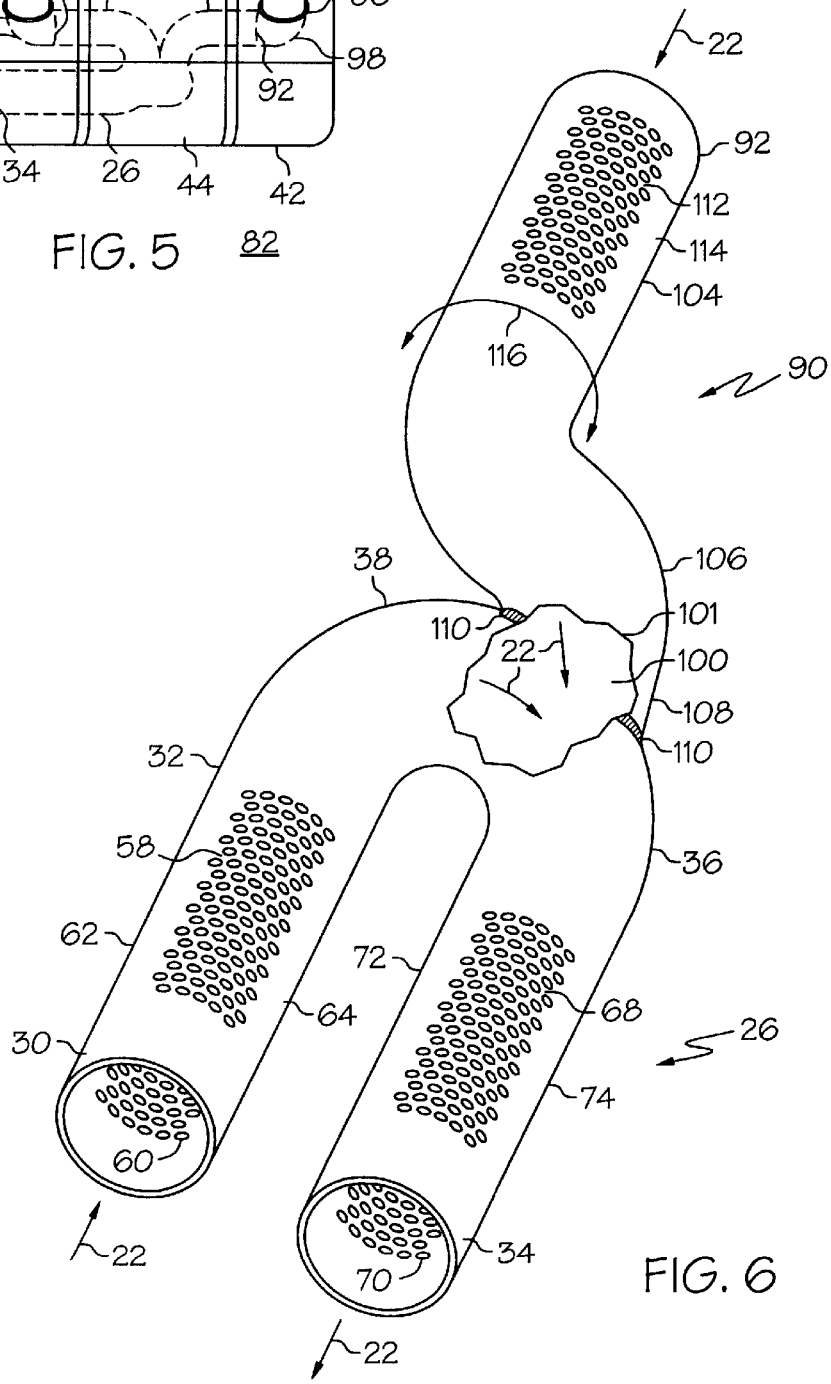
FIG. 6 shows a curved inner tube and a second inner tube of the exhaust muffler of FIG. 5.

Referring to FIG. 6 in connection with FIG. 5, FIG. 6 shows curved inner tube 26 and second inner tube 90 of dual-in/single-out exhaust muffler 82. Curved inner tube 26 includes first leg 32, second leg 36, and imperforate curved portion 38 interconnecting first and second legs 32 and 36, respectively. In addition, first leg 32 includes first and second perforate regions 58 and 60, respectively, and first and second imperforate regions 62 and 64, respectively, as described in connection with FIG. 4. Likewise, second leg 36 includes third and fourth perforate regions 68 and 70, respectively, and third and fourth imperforate regions 72 and 74, respectively, also described in connection with FIG. 4.

An opening 100 is located in curved portion 38 of curved inner tube 36 proximate second leg 36. Opening 100 is viewable through an illustrative cutaway view 101 of curved inner tube 26 and second inner tube 90 at the position where second inner tube 90 intersects curved portion 38 of curved inner tube 26.

Second inner tube 92 includes a straight member 104 axially aligned with first leg 32 of curved inner tube 26. Second inner tube 92 further includes a curved member 106 interconnecting straight member 104 with an exhaust outlet end 108 of second inner tube 90. Curved member 106 is configured to accommodate an intersection of exhaust outlet end 108 with curved portion 38 of curved inner tube 26 at opening 100. Exhaust outlet end 108 of second inner tube 90 is coupled to curved inner tube 26 via a weld 110 and extends from opening 100.

A fifth perforate region 112 and a fifth imperforate region 114 are arranged about a circumference (represented by a bi-directional arrow 116) of straight member 104 of second inner tube 90. Like perforate regions 58, 60, 68, and 70, fifth perforate region 112 allows gas expansion and sound travel through sound absorbing material 40 (FIG. 2) located in a cavity 78 (FIG. 2) of muffler housing 42.

It has been determined that the inclusion of fifth perforate region 112 with first, second, third, and fourth perforate regions 58, 60, 68, and 70 produces the desired resonance accompanied by enhanced engine performance in dual-in/single-out muffler 82. Furthermore, muffler 82 has the benefit of enhanced strength and durability.

However, this configuration should not be construed as limiting. By way of example, for continuity with the perforate and imperforate regions of first and second legs 32 and 36, respectively, straight member 104 may also a sixth perforate region (not shown) and a sixth imperforate region (not shown). Alternatively, straight member 104 of second inner tube 90 may be entirely perforate about circumference 116. Such perforation about the entirety of circumference 116 does not undesirably cause high frequency resonance or buzzing in the resulting exhaust sound since straight member 104 is not placed in facing relationship with another tubular member, such as first and second legs 32 and 36, respectively.

As shown in illustrative cutaway view 101, exhaust gas 22 received at first end 30 of curved inner tube 26 flows through first leg 32, curved portion 38, and second leg 36 to exit from second end 34 of second leg 36 to be subsequently exhausted from a tail pipe (not shown) coupled to exhaust outlet 88. In addition, exhaust gas 22 received at third end 92 of second inner tube 90 flows through straight member 104 and curved member 106 to exit from second inner tube 90 at exhaust outlet end 108. From exhaust outlet end 108, exhaust gas 22 passes through opening 100 and into second leg 36 to exit from second end 34 of second leg 36 to be subsequently exhausted from the tail pipe.

Figure 7:
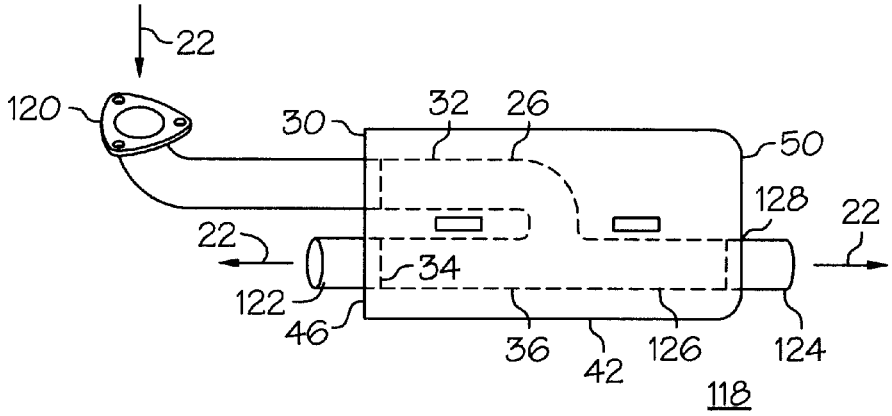
FIG. 7 shows a perspective view of an exhaust muffler in accordance with another alternative embodiment of the present invention.

FIG. 7 shows a perspective view of an exhaust muffler 118 in accordance with another alternative embodiment of the present invention. Exhaust muffler 118 includes a single exhaust inlet 120, a first exhaust outlet 122, and a second exhaust outlet 124. Exhaust inlet 120 is configured to receive exhaust gas 22 from an internal combustion engine (not shown) and each of first and second exhaust outlets 122 and 124 are configured to output exhaust gas 22. Accordingly, muffler 118 will be referred to hereinafter as single-in/dual-out muffler 118 to distinguish it from other exhaust mufflers configured in accordance with alternative embodiments of the present invention. Single-in/dual-out muffler 120 is a direct bolt replacement for the original equipment muffler on sports cars, such as on some model year Porsche sports cars.

Single-in/dual-out muffler 118 is also an adaptation of single-in/single-out muffler 20 (FIGS. 1–4). In particular, muffler 118 includes curved inner tube 26 (shown in ghost form). However, single-in/dual-out muffler 118 further includes a second inner tube 126 (shown in ghost form) enclosed by muffler housing 42. Exhaust inlet 120 is in communication with first end 30 of first leg 32 curved inner tube 26 and first exhaust outlet 122 is in communication with second end 34 of second leg 36 of curved inner tube 26. In addition, second exhaust outlet 124 is in communication with a third end 128 of second inner tube 126. Like single-in/single-out muffler 20, single-in/dual-out muffler 118 also includes sound absorbing material 40 (FIG. 2), in the form of steel wool mesh, wrapped around curved inner tube 26 and second inner tube 126 and enclosed in cavity 78 (FIG. 2) of muffler housing 42.

Exhaust inlet 120 and first exhaust outlet 122 are directed through ports in first end cap 46 of muffler housing 42, as discussed in connection with FIG. 3. In addition, second exhaust outlet 124 is directed through a port in second end cap 50 of muffler housing 42, in much the same manner as the ports in first end cap 46.

Figure 8:
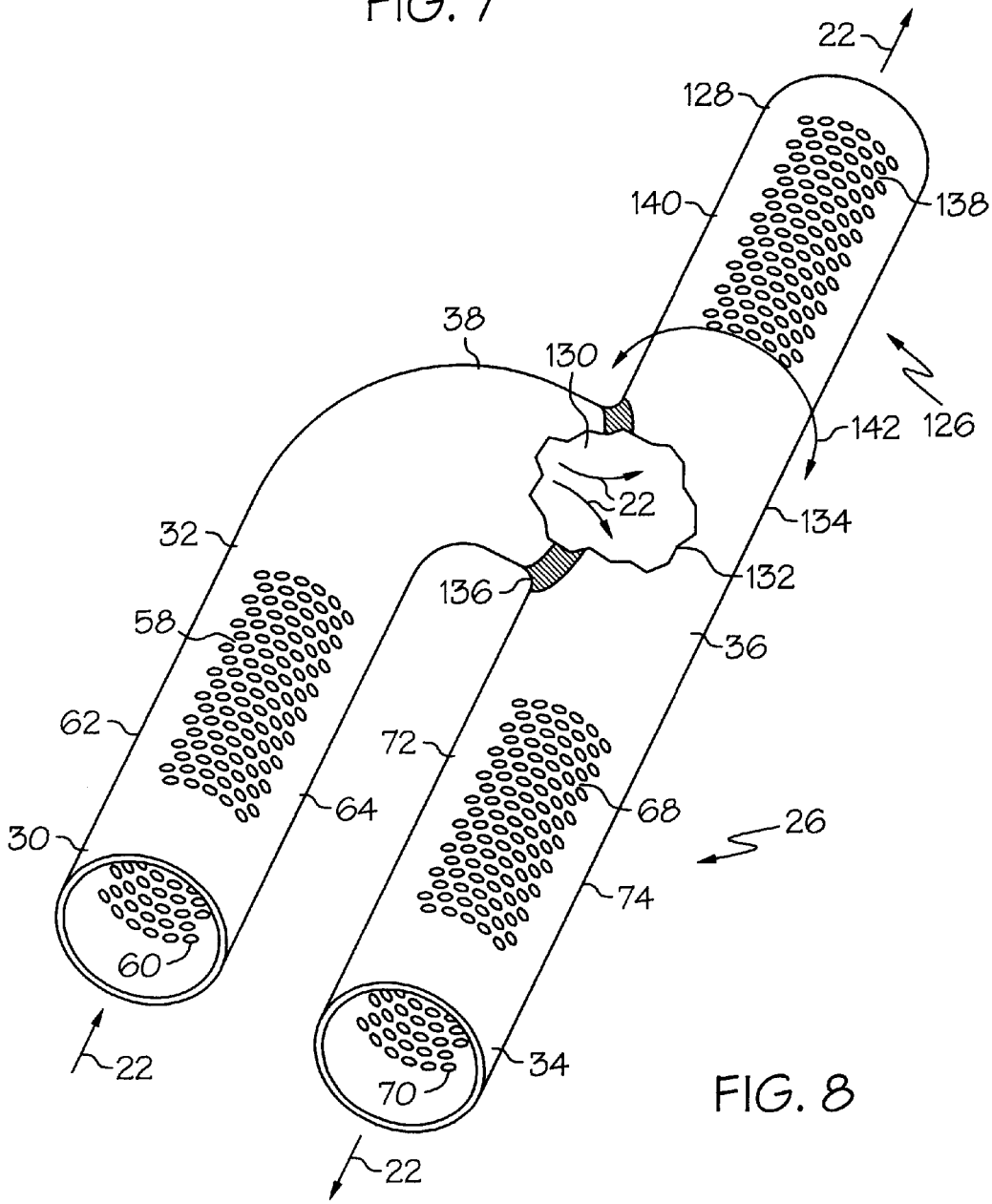
FIG. 8 shows a curved inner tube and a second inner tube of the exhaust muffler of FIG. 7.

Referring to FIG. 8 in connection with FIG. 7, FIG. 8 shows curved inner tube 26 and second inner tube 126 of single-in/dual-out exhaust muffler 118. Curved inner tube 26 includes first leg 32, second leg 36, and imperforate curved portion 38 interconnecting first and second legs 32 and 36, respectively. In addition, first leg 32 includes first and second perforate regions 58 and 60, respectively, and first and second imperforate regions 62 and 64, respectively, as described in connection with FIG. 4. Likewise, second leg 36 includes third and fourth perforate regions 68 and 70, respectively, and third and fourth imperforate regions 72 and 74, respectively, also described in connection with FIG. 4.

An opening 130 is located in curved portion 38 of curved inner tube 36 proximate second leg 36. Opening 130 is viewable through an illustrative cutaway view 132 of curved inner tube 26 and second inner tube 126 at the position where second inner tube 126 intersects curved portion 38 of curved inner tube 26.

Second inner tube 126 is a substantially straight member axially aligned with second leg 36 of curved inner tube 26.

Second inner tube 126 is configured to accommodate an intersection of an exhaust inlet end 134 of second inner tube 126 with curved portion 38 of curved inner tube 26 at opening 130. Exhaust inlet end 134 of second inner tube 126 is coupled to curved inner tube 26 via a weld 136 and extends from opening 130.

To simplify the manufacture of single-in/dual-out muffler 118, second inner tube 126 and second leg 36 of curved inner tube 26 may be formed from a single tubular member. As such, first leg 32 and curved portion 38 of curved inner tube 26 may then be welded onto the single tubular member about opening 130, as shown by the location of weld 136 in FIG. 8.

A fifth perforate region 138 and a fifth imperforate region 140 are arranged about a circumference (represented by a bi-directional arrow 142) of straight member second inner tube 126. Like perforate regions 58, 60, 68, and 70, fifth perforate region 138 allows gas expansion and sound travel through sound absorbing material 40 (FIG. 2) located in a cavity 78 (FIG. 2) of muffler housing 42.

It has been determined that the inclusion of fifth perforate region 138 with first, second, third, and fourth perforate regions 58, 60, 68, and 70 produces the desired resonance accompanied by enhanced engine performance in single-in/dual-out muffler 118. Furthermore, muffler 118 has the benefit of enhanced strength and durability.

However, this configuration should not be construed as limiting. By way of example, for continuity with the perforate and imperforate regions of first and second legs 32 and 36, respectively, second inner tube 126 may also a sixth perforate region (not shown) and a sixth imperforate region (not shown). Alternatively, second inner tube 126 may be entirely perforate about circumference 142. Such perforation about the entirety of circumference 142 does not undesirably cause high frequency resonance or buzzing in the resulting exhaust sound since straight member second inner tube 126 is not placed in facing relationship with another tubular member, such as first and second legs 32 and 36, respectively.

As shown in illustrative cutaway view 132, exhaust gas 22 received at first end 30 of curved inner tube 26 flows through first leg 32 and curved portion 38 through opening 130. At opening 130, some of exhaust gas 22 flows into second leg 36 to exit from second end 34 of second leg 36 to be subsequently exhausted from a first tail pipe (not shown) coupled to first exhaust outlet 122. In addition, some of exhaust gas 22 received at exhaust inlet end 134 flows through second inner tube 126 to exit from second inner tube 126 at third end 128 and to be subsequently exhausted from a second tail pipe (not shown) coupled to second exhaust outlet 124.

Figure 9:
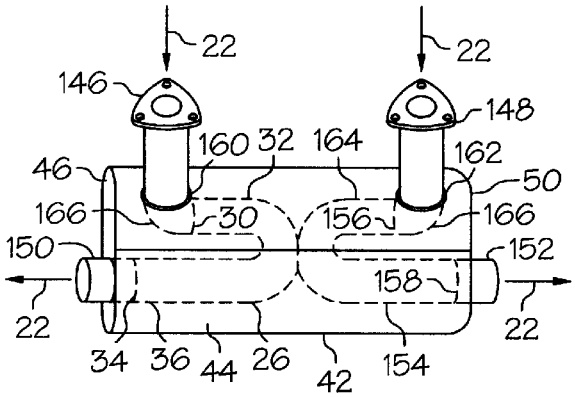
FIG. 9 shows a perspective view of an exhaust muffler in accordance with yet another alternative embodiment of the present invention.

FIG. 9 shows a perspective view of an exhaust muffler 144 in accordance with yet another alternative embodiment of the present invention. Exhaust muffler 144 includes a first exhaust inlet 146, a second exhaust inlet 148, first exhaust outlet 150, and a second exhaust outlet 152. First and second exhaust inlets 146 and 148, respectively are configured to receive exhaust gas 22 from an internal combustion engine (not shown) and each of first and second exhaust outlets 150 and 152 are configured to output exhaust gas 22. Accordingly, muffler 144 will be referred to hereinafter as dual-in/dual-out muffler 144 to distinguish it from other exhaust mufflers configured in accordance with alternative embodiments of the present invention. Dual-in/dual-out muffler 144 is a direct bolt replacement for the original equipment muffler on sports cars, such as on some model year Porsche sports cars.

Dual-in/dual-out muffler 144 is also an adaptation of single-in/single-out muffler 20 (FIGS. 1–4). In particular, muffler 144 includes curved inner tube 26 (shown in ghost form). However, dual-in/dual-out muffler 144 also includes a second curved inner tube 154 (shown in ghost form) enclosed by muffler housing 42.

First exhaust inlet 146 is in communication with first end 30 of first leg 32 of curved inner tube 26 and first exhaust outlet 150 is in communication with second end 34 of second leg 36 of curved inner tube 26. Likewise, second exhaust inlet 148 is in communication with a third end 156 of second curved inner tube 154 and second exhaust outlet 152 is in communication with a fourth end 158 of second curved inner tube 154. Like single-in/single-out muffler 20 (FIGS. 1–3), dual-in/dual-out muffler 144 also includes sound absorbing material 40 (FIG. 2), in the form of steel wool mesh, wrapped around curved inner tube 26 and second curved inner tube 154 and enclosed in cavity 78 (FIG. 2) of muffler housing 42.

First and second exhaust inlets 146 and 148, respectively are directed through first and second ports 160 and 162, respectively, located in shell 44 of housing 42. Accordingly, first leg 32 of curved inner tube 26 and a third leg 164 of second curved inner tube 154 are adapted, by the inclusion of elbows 166, to accommodate the location of first and second ports 160 and 162. First exhaust outlet 150 is directed through a port in first end cap 46 of muffler housing 42, as discussed in connection with FIG. 3. In addition, second exhaust outlet 152 is directed through a port in second end cap 50 of muffler housing 42, in much the same manner as the port in first end cap 46.

Figure 10:
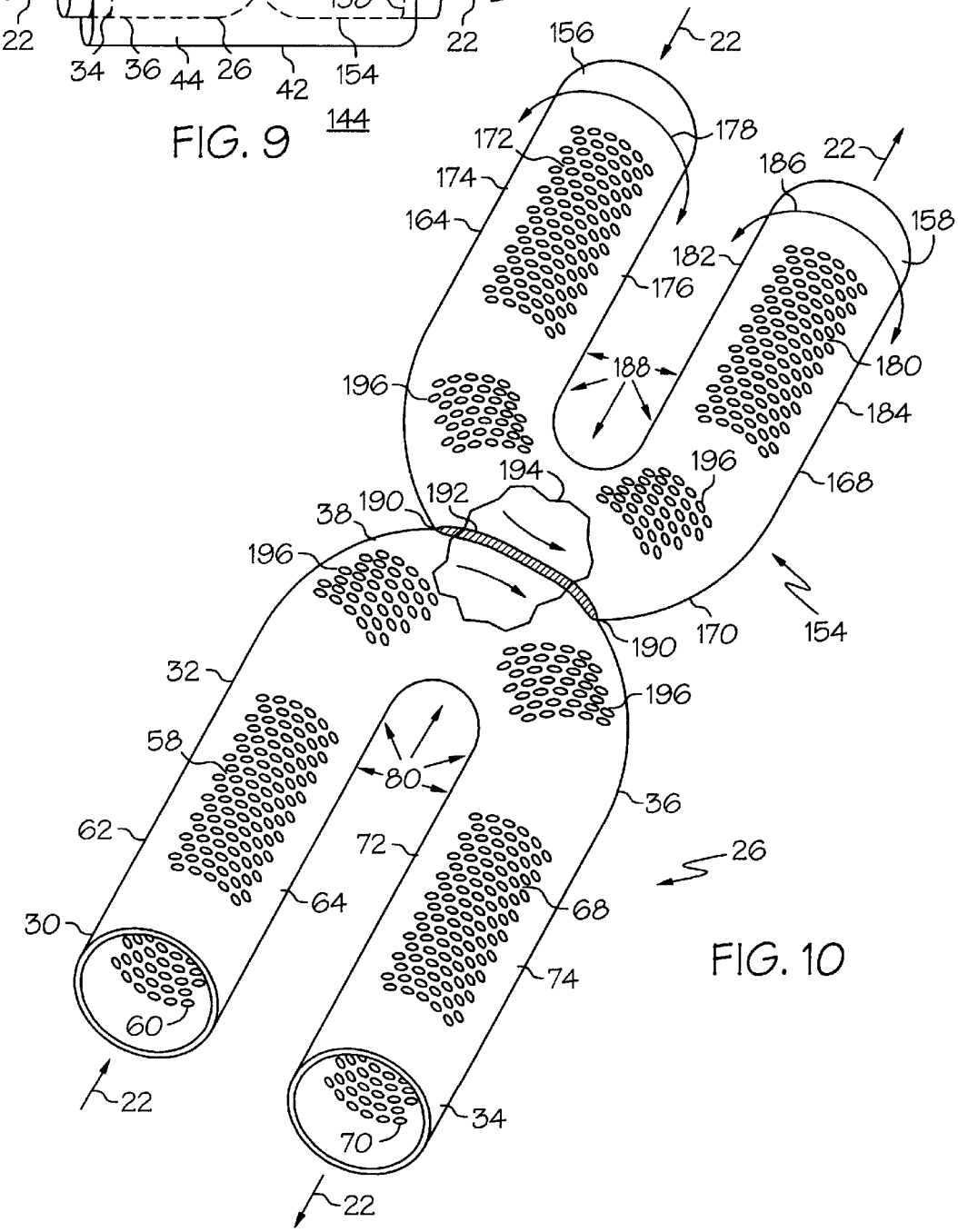
FIG. 10 shows first and second curved inner tubes of the exhaust muffler of FIG. 9.

Referring to FIG. 10 in connection with FIG. 9, FIG. 9 shows curved inner tube 26 and second curved inner tube 154 of dual-in/dual-out exhaust muffler 144. Curved inner tube 26 includes first leg 32, second leg 36, and curved portion 38 interconnecting first and second legs 32 and 36, respectively. In addition, first leg 32 includes first and second perforate regions 58 and 60, respectively, and first and second imperforate regions 62 and 64, respectively, as described in connection with FIG. 4. Likewise, second leg 36 includes third and fourth perforate regions 68 and 70, respectively, and third and fourth imperforate regions 72 and 74, respectively, also described in connection with FIG. 4.

Second curved inner tube 154 is a duplicate of curved inner tube 26. As such, second curved inner tube 154 includes third leg 164, a fourth leg 168, and a curved portion 170 interconnecting third and fourth legs 164 and 168, respectively. In addition, third leg 164 includes a fifth perforate region 172 and a sixth perforate region (not shown) and fifth and sixth imperforate regions 174 and 176, respectively, arranged about a circumference (represented by a bi-directional arrow 178) of third leg 164, as described in connection with first and second perforate regions 58 and 60, and first and second imperforate regions 62 and 64 of FIG. 4. Likewise, fourth leg 168 includes a seventh perforate region 180, an eighth perforate region (not shown), and seventh and eighth imperforate regions 182 and 184, respectively, arranged about a circumference (represented by a bi-directional arrow 186) of fourth leg 168, as described in connection with third and fourth perforate regions 68 and 70, and third and fourth imperforate regions 72 and 74 of FIG. 4.

Perforations in fifth perforate region 172, the sixth perforate region (not shown), seventh perforate region 180, and the eighth perforate region (not shown) allow gas expansion of exhaust gas 22 and sound travel through sound absorbing material 40 located in a cavity 78 (FIGS. 2–3) of muffler housing 42. Like the facing relationship between first and second legs 32 and 36, respectively, third leg 164 is aligned with fourth leg 168 so that sixth imperforate region 176 faces seventh imperforate region 182 on an inside curve 188 of second curved inner tube 154. This facing relationship between sixth and seventh imperforate regions 176 and 178, respectively, largely inhibits gas expansion and sound travel between third and fourth legs 164 and 168, respectively.

Curved inner tube 26 and second curved inner tube 154 are coupled via a weld 190 at curved portion 38 and curved portion 170. The passageways of curved portions 38 and 170 are separated by an imperforate wall 192, shown in an illustrative cutaway view 194. As shown in illustrative cutaway view 194, imperforate wall 192 separates exhaust gas 22 flowing through curved portion 38 from exhaust gas 22 flowing through curved portion 170.

Additional perforate regions 196 are located on curved inner tube 26 and second curved inner tube 154 proximate curved portions 38 and 170. Perforate regions 196 also allow gas expansion of exhaust gas 22 and sound travel through sound absorbing material 40 located in a cavity 78 (FIGS. 2–3) of muffler housing 42. It has been determined that a total of four of perforate regions 196 (two on each of curved inner tube 26 and second curved inner tube 154), in combination with the perforate regions on first, second, third, and fourth legs 32, 36, 164, and 168, respectively, yields a desired throaty exhaust sound for dual-in/dual-out muffler 144. This desired throaty sound is accompanied by enhanced horsepower due to the largely non-restricted flow of exhaust gas 22 through curved inner tube 26 and second curved inner tube 154.

In operation of dual-in/dual-out muffler 144, exhaust gas 22 received at first end 30 of curved inner tube 26 from first exhaust inlet 146 flows through first leg 32, curved portion 38, and second leg 36 to exit from second end 34 of second leg 36 to be subsequently exhausted from a first tail pipe (not shown) coupled to first exhaust outlet 150. Likewise, exhaust gas 22 received at third end 156 of second curved inner tube 154 from second exhaust inlet 148 flows through third leg 164, curved portion 170, and fourth leg 168 to exit from fourth end 158 to be subsequently exhausted from a second tail pipe (not shown) coupled to second exhaust outlet 152.

In summary, the present invention teaches of an exhaust muffler for an internal combustion engine that is particularly suited for the high performance engines found in sports cars.

The exhaust muffler produces a deep, throaty, sports car sound through the strategic placement of perforate and imperforate regions. In particular, the inside curve of the legs of the curved inner tube that face one another are imperforate to inhibit gas expansion between the legs of the tubes. Furthermore, the desired resonance is provided without causing undue back pressure to the engine. That is, engine performance is enhanced by the largely non-restricted flow of exhaust gas from the exhaust inlet to the exhaust outlet through the curved inner tube. The steel wool mesh sound absorbing material, the stainless steel construction, and TIG welding yields a durable exhaust muffler system. In addition, the similarity of design between the alternative embodiments of the muffler and the direct bolt structure allows the muffler to be readily, and cost effectively, adaptable to a number of vehicular exhaust system configurations.

Although the preferred embodiments of the invention have been illustrated and described in detail, it will be readily apparent to those skilled in the art that various modifications may be made therein without departing from the spirit of the invention or from the scope of the appended claims. For example, the inner tube or tubes may be shaped differently than what is described to accommodate different vehicular exhaust system configurations and there may be more or less perforated regions than what is described.

What is claimed is:

1. An exhaust muffler for an internal combustion engine comprising:

a curved inner tube including:

a first leg having a first perforate region and a first imperforate region arranged about a circumference of said first leg;

a second leg having a second perforate region and a second imperforate region arranged about a circumference of said second leg, said second leg being aligned with said first leg so that said second imperforate region faces said first imperforate region on an inside curve of said curved inner tube; and a curved portion interconnecting said first and second legs;

an exhaust inlet in communication with a first end of said first leg and configured to receive exhaust gas from said engine;

an exhaust outlet in communication with a second end of said second leg and configured to output said exhaust gas; and a muffler housing enclosing said curved inner tube, said exhaust inlet and said exhaust outlet extending from said muffler housing.

2. An exhaust muffler as claimed in claim 1 wherein:

said first leg includes:

a third perforate region located about said circumference of said first leg in opposing relationship with said first perforate region; and a third imperforate region located about said circumference of said first leg in opposing relationship with said first imperforate region; and said second leg includes:

a fourth perforate region located about said circumference of said second leg in opposing relationship with said second perforate region; and a fourth imperforate region located about said circumference of said second leg in opposing relationship with said fourth imperforate region.

3. An exhaust muffler as claimed in claim 1 wherein said curved portion is imperforate.

4. An exhaust muffler as claimed in claim 1 wherein said exhaust inlet is a first exhaust inlet, and said muffler further comprises:

a second inner tube enclosed by said muffler housing and extending from an opening in said curved inner tube; and a second exhaust inlet in communication with a third end of said second inner tube and configured to receive said exhaust gas from said engine.

5. An exhaust muffler as claimed in claim 4 wherein said second inner tube has a third perforate region and a third imperforate region arranged about a circumference of said second inner tube.

6. An exhaust muffler as claimed in claim 4 wherein:

said opening is located in said curved portion of said curved inner tube proximate said second leg; and said second inner tube includes:

a straight member axially aligned with said first leg of said curved inner tube; and a curved member interconnecting said straight member with an exhaust outlet end of said second inner tube, said curved member being configured to accommodate an intersection of said exhaust outlet end with said curved portion of said curved inner tube at said opening.

7. An exhaust muffler as claimed in claim 1 wherein said exhaust outlet is a first exhaust outlet, said muffler further comprises:

a second inner tube enclosed by said muffler housing and extending from an opening in said curved inner tube; and a second exhaust outlet in communication with a third end of said second inner tube and configured to output said exhaust gas.

8. An exhaust muffler as claimed in claim 7 wherein said second inner tube has a third perforate region and a third imperforate region arranged about a circumference of said second inner tube.

9. An exhaust muffler as claimed in claim 7 wherein:

said opening is located in said curved portion of said curved inner tube proximate said second leg; and said second inner tube is a substantially straight member axially aligned with said second leg and configured to accommodate an intersection of an exhaust inlet end of said second inner tube with said curved portion of said curved inner tube at said opening.

10. An exhaust muffler as claimed in claim 1 wherein said curved inner tube is a first curved inner tube, and said exhaust muffler further comprises a second curved inner tube enclosed by said muffler housing, said second curved inner tube including:

a third leg having a third perforate region and a third imperforate region arranged about a circumference of said third leg;

a fourth leg having a fourth perforate region and a fourth imperforate region arranged about a circumference of said fourth leg, said fourth leg being aligned with said third leg so that said fourth imperforate region faces said third imperforate region on an inside curve of said second curved inner tube; and a second curved portion interconnecting said third and fourth legs;

a second exhaust inlet in communication with a third end of said third leg and configured to receive exhaust gas from said engine; and a second exhaust outlet in communication with a fourth end of said fourth leg and configured to output said exhaust gas.

11. An exhaust muffler as claimed in claim 10 wherein said curved portion of said first inner tube is a first curved portion, and said first and second inner tubes are coupled at said first and second curved portions.

12. An exhaust muffler as claimed in claim 11 wherein said first and second curved portions are imperforate to separate a flow of said exhaust gas through said first curved portion from a flow of said exhaust gas through said second curved portion.

13. An exhaust muffler as claimed in claim 11 wherein said curved portion of said first inner tube is a first curved portion, and each of said first and second curved inner tubes includes perforate regions proximate respective ones of said first and second curved portions.

14. An exhaust muffler as claimed in claim 1 wherein said muffler housing includes:

a shell surrounding said curved inner tube;

a first end cap coupled to a first end of said shell;

a second end cap coupled to a second end of said shell;

a first port through which said exhaust inlet of said inner tube is directed; and a second port through which said exhaust outlet of said outer tube is directed.

15. An exhaust muffler as claimed in claim 1 further comprising a sound absorbing material surrounding said curved inner tube and enclosed within said muffler housing.

16. An exhaust muffler as claimed in claim 15 wherein said sound absorbing material is steel wool.

17. An exhaust muffler for an internal combustion engine comprising:

a curved inner tube including:

a first leg having a first perforate region and a first imperforate region arranged about a circumference of said first leg;

a second leg having a second perforate region and a second imperforate region arranged about a circumference of said second leg, said second leg being aligned with said first leg so that said second imperforate region faces said first imperforate region and said second perforate region faces away from said first perforate region; and a curved portion interconnecting said first and second legs;

an exhaust inlet in communication a first end of said first leg and configured to receive exhaust gas from said engine;

an exhaust outlet in communication with a second end of said second leg and configured to output said exhaust gas;

a muffler housing enclosing said curved inner tube, said muffler housing including:

a shell axially aligned with said curved inner tube;

a first end cap coupled to a first end of said shell;

a second end cap coupled to a second end of said shell;

a first port through which said exhaust inlet of said inner tube is directed; and a second port through which said exhaust outlet of said outer tube is directed, said first and second ports being located in one of said first and second end caps; and a sound absorbing material surrounding said curved inner tube and enclosed within said muffler housing.

18. An exhaust muffler for an internal combustion engine comprising:

a curved inner tube including:

a first leg having first and second perforate regions and first and second imperforate regions, said first perforate region being located about a circumference of said first leg in opposing relationship with said second perforate region, and said first imperforate region being located about said circumference in opposing relationship with said second imperforate region;

a second leg having third and fourth perforate regions and third and fourth imperforate regions, said third perforate region being located about a circumference of said second leg in opposing relationship with said fourth perforate region, and said third imperforate region being located about said circumference in opposing relationship with said fourth imperforate region, said second leg being aligned with said first leg so that said third imperforate region faces said second imperforate region on an inside curve of said curved inner tube; and a curved portion interconnecting said first and second legs;

a first exhaust inlet in communication with a first end of said first leg and configured to receive exhaust gas from said engine;

an exhaust outlet in communication with a second end of said second leg and configured to output said exhaust gas;

a second inner tube enclosed by said muffler housing and extending from an opening in said curved inner tube; and a second exhaust inlet in communication with a third end of said second inner tube and configured to receive said exhaust gas from said engine.

19. An exhaust muffler as claimed in claim 18 wherein said second inner tube has a third perforate region and a third imperforate region arranged about a circumference of said second inner tube.

20. An exhaust muffler as claimed in claim 18 wherein:

said opening is located in said curved portion of said curved inner tube proximate said second leg; and said second inner tube includes:

a straight member axially aligned with said first leg of said curved inner tube; and a curved member interconnecting said straight member with an exhaust outlet end of said second inner tube, said curved member being configured to accommodate an intersection of said exhaust outlet end with said curved portion of said curved inner tube at said opening.

21. An exhaust muffler for an internal combustion engine comprising:

a curved inner tube including:

a first leg having first and second perforate regions and first and second imperforate regions, said first perforate region being located about a circumference of said first leg in opposing relationship with said second perforate region, and said first imperforate region being located about said circumference in opposing relationship with said second imperforate region;

a second leg having third and fourth perforate regions and third and fourth imperforate regions, said third perforate region being located about a circumference of said second leg in opposing relationship with said fourth perforate region, and said third imperforate region being located about said circumference in opposing relationship with said fourth imperforate region, said second leg being aligned with said first leg so that said third imperforate region faces said second imperforate region on an inside curve of said curved inner tube; and a curved portion interconnecting said first and second legs;

an exhaust inlet in communication with a first end of said first leg and configured to receive exhaust gas from said engine;

a first exhaust outlet in communication with a second end of said second leg and configured to output said exhaust gas;

a second inner tube enclosed by said muffler housing and extending from an opening in said curved inner tube;

a second exhaust outlet in communication with a third end of said second inner tube and configured to output said exhaust gas; and a muffler housing enclosing said curved inner tube and said second inner tube, said exhaust inlet, said first exhaust outlet, and said second exhaust outlet extending from said muffler housing.

22. An exhaust muffler as claimed in claim 21 wherein said second inner tube has a third perforate region and a third imperforate region arranged about a circumference of said second inner tube.

23. An exhaust muffler as claimed in claim 21 wherein:

said opening is located in said curved portion of said curved inner tube proximate said second leg;

said second exhaust outlet is axially aligned with said first exhaust outlet; and said second inner tube is a substantially straight member configured to accommodate an intersection of an exhaust inlet end of said second inner tube with said curved portion of said curved inner tube at said opening.

24. An exhaust muffler as claimed in claim 21 further comprising a steel wool sound absorbing material surrounding said curved inner tube and said second inner tube, said steel wool sound absorbing material being enclosed within said muffler housing.

25. An exhaust muffler for an internal combustion engine comprising:

a first curved inner tube including:

a first leg having first and second perforate regions and first and second imperforate regions, said first perforate region being located about a circumference of said first leg in opposing relationship with said second perforate region, and said first imperforate region being located about said circumference in opposing relationship with said second imperforate region;

a second leg having third and fourth perforate regions and third and fourth imperforate regions, said third perforate region being located about a circumference of said second leg in opposing relationship with said fourth perforate region, and said third imperforate region being located about said circumference in opposing relationship with said fourth imperforate region, said second leg being aligned with said first leg so that said third imperforate region faces said second imperforate region on an inside curve of said curved inner tube; and a first curved portion interconnecting said first and second legs;

a first exhaust inlet in communication with a first end of said first leg and configured to receive exhaust gas from said engine;

a first exhaust outlet in communication with a second end of said second leg and configured to output said exhaust gas;

second curved inner tube including:

a third leg having a fifth perforate region and a fifth imperforate region arranged about a circumference of said third leg;

a fourth leg having a sixth perforate region and a sixth imperforate region arranged about a circumference of said fourth leg, said fourth leg being aligned with said third leg so that said fourth imperforate region faces said third imperforate region on an inside curve of said second curved inner tube; and a second curved portion interconnecting said third and fourth legs;

a second exhaust inlet in communication with a third end of said third leg and configured to receive exhaust gas from said engine; and a second exhaust outlet in communication with a fourth end of said fourth leg and configured to output said exhaust gas; and a muffler housing enclosing said first and second curved inner tubes, said first and second exhaust inlets and said first and second exhaust outlets extending from said muffler housing.

26. An exhaust muffler as claimed in claim 25 wherein said first and second inner tubes are coupled at said first and second curved portions.

27. An exhaust muffler as claimed in claim 26 wherein said first and second curved portions are imperforate to separate a flow of said exhaust gas through said first curved portion from a flow of said exhaust gas through said second curved portion.

28. An exhaust muffler as claimed in claim 25 wherein each of said first and second curved inner tubes includes perforate regions proximate respective ones of said first and second curved portions.

29. An exhaust muffler as claimed in claim 25 further comprising a steel wool sound absorbing material surrounding said first and second curved inner tubes, said steel wool sound absorbing material being enclosed within said muffler housing.

* * * * *